US005483893A

United States Patent [19]

Isaac et al.

[11] Patent Number: 5,483,893

[45] Date of Patent: Jan. 16, 1996

[54] CONTROL SYSTEM AND METHOD FOR AUTOMATICALLY IDENTIFYING WEBS IN A PRINTING PRESS

[76] Inventors: Ragy Isaac, 895 Brompton Cir., Bolingbrook, Ill. 60440; Richard Fedrigon, 935 Ontario St., Oak Park, Ill. 60302; Edward Hudyma, 631 Derbyshire La., Bolingbrook, Ill. 60440

[21] Appl. No.: 414,079

[22] Filed: Mar. 31, 1995

[51] Int. Cl.[6] ..... B41F 13/12

[52] U.S. Cl. ..... 101/485; 101/226; 101/248; 226/45; 250/559.2; 250/559.26; 250/559.44

[58] Field of Search ..... 101/226, 219, 101/224, 247, 248, 181, 483, 484, 485, 491; 364/469, 471; 250/559.01, 559.04, 559.07, 559.19, 559.2, 559.26, 559.39, 559.44; 226/24, 27, 28, 44, 45

[56] References Cited

U.S. PATENT DOCUMENTS

| | | | |
|---|---|---|---|
| 3,806,012 | 4/1974 | Roch | 226/28 |
| 4,147,104 | 4/1979 | Zernov et al. | 101/181 |
| 4,264,957 | 4/1981 | Pautzke | 101/248 |
| 4,719,575 | 1/1988 | Gnuechtel | 364/469 |
| 4,951,223 | 8/1990 | Wales | 101/248 |
| 5,190,234 | 3/1993 | Ezekiel | 242/58.1 |

*Primary Examiner*—Eugene H. Eickholt

[57] ABSTRACT

A continuous web printing press (100) having a control system (202) for automatically identifying which one of a plurality of paper webs (108, 120) is running through which one of a plurality of compensators (146, 148) is provided. First and second marking devices (138, 140) apply reference marks (142, 144) on the respective webs (108, 120) to uniquely identify each web (108, 120). Preferably, the reference marks (142, 144) are comprised of a magnetized material, such as a magnetized label. A sensor (154, 156) is positioned at each of the compensators (146, 148) for sensing the reference marks (142, 144) located on the web (108, 120) running through the compensator (146, 148) to automatically identify which web (108, 120) is running through which compensator (146, 148). The marks (142, 144) on the web (108, 120) are preferably positioned on the webs (108, 120) to uniquely identify the webs (108, 120). A computer circuit (200) uses this information to control the path lengths of the webs (108, 120) via the compensators (146, 148). A method is also provided for automatically identifying which web (108, 120) is running through which compensator (146, 148).

16 Claims, 3 Drawing Sheets

CONTROL SYSTEM AND METHOD FOR AUTOMATICALLY IDENTIFYING WEBS IN A PRINTING PRESS

BACKGROUND OF THE INVENTION

The present invention relates generally to control systems for printing presses and, more particularly, to printing press control systems which automatically identify which one of a plurality of webs is running through any one of a plurality of compensators.

Continuous web printing presses, such as high speed, high volume rotary presses used, for example, to print newspapers and the like, generally have a plurality of paper webs. These plurality of webs are supplied from a plurality of separate printing units, are superimposed on one another and are sent to a single folding/cutting mechanism. Each printing unit has at least one plate cylinder and at least one blanket cylinder for printing on a web. Each printing unit also has numerous other running cylinders and rollers for threading the web through the printing unit and the folding/cutting mechanism. It is necessary that the cutter mechanism cut the webs at imaginary page boundary lines between the adjacent pages as printed on the web. In known rotary printing presses, the cutter mechanism is stationary with respect to the cylinders that print the image on each web, and the proper cut-off registration is achieved by adjusting each web path length via one or more compensators.

A computerized control system controls the path length of each web by activating the appropriate compensator. Operating characteristics of the printing units and webs are used by the control system to regulate the compensators, such as web speed, thickness of the web and the like. Sensors mounted on the press monitor these operating characteristics and provide the information to the control system. Unfortunately, current control systems in printing presses are unable to automatically identify which web is running through which compensator. Press operators consequently must manually provide this information prior to starting the press.

Accordingly, there is a need in the art for a control system for a printing press having a plurality of webs and compensators for regulating the path lengths of the webs which automatically identifies which one of the webs is running through any one of the compensators.

SUMMARY OF THE INVENTION

This need is met by a control system for a printing press in accordance with the present invention which automatically uniquely identifies which web is running through which compensator.

The control system includes one or more marking devices for applying detectable reference marks on the webs to uniquely identify each web. A mark sensor is located at each of the compensators to detect the reference marks on the particular web running through each compensator. Based on the detection of the reference marks, a computer circuit automatically identifies which web is running through which compensator and regulates the operation of the webs, accordingly.

Preferably, the reference marks are positioned on the webs in predetermined locations which uniquely identify the webs. The computer circuit then identifies which web is running through which compensator based on the location of the marks on the webs. The computer circuit thereafter regulates the operating characteristics, such as web tension level, web cuts and the like, based on the unique identification of the webs. In particular, the computer circuit activates the compensators to increase and decrease the path lengths of the respective webs.

It is thus a feature of the present invention to provide a control system and method for a printing press which automatically identifies which web is running through which compensator.

These and other features and advantages of the present invention will become apparent from the following detailed description, the accompanying drawings and the appended claims.

DETAILED DESCRIPTION OF THE INVENTION

Figure 1:
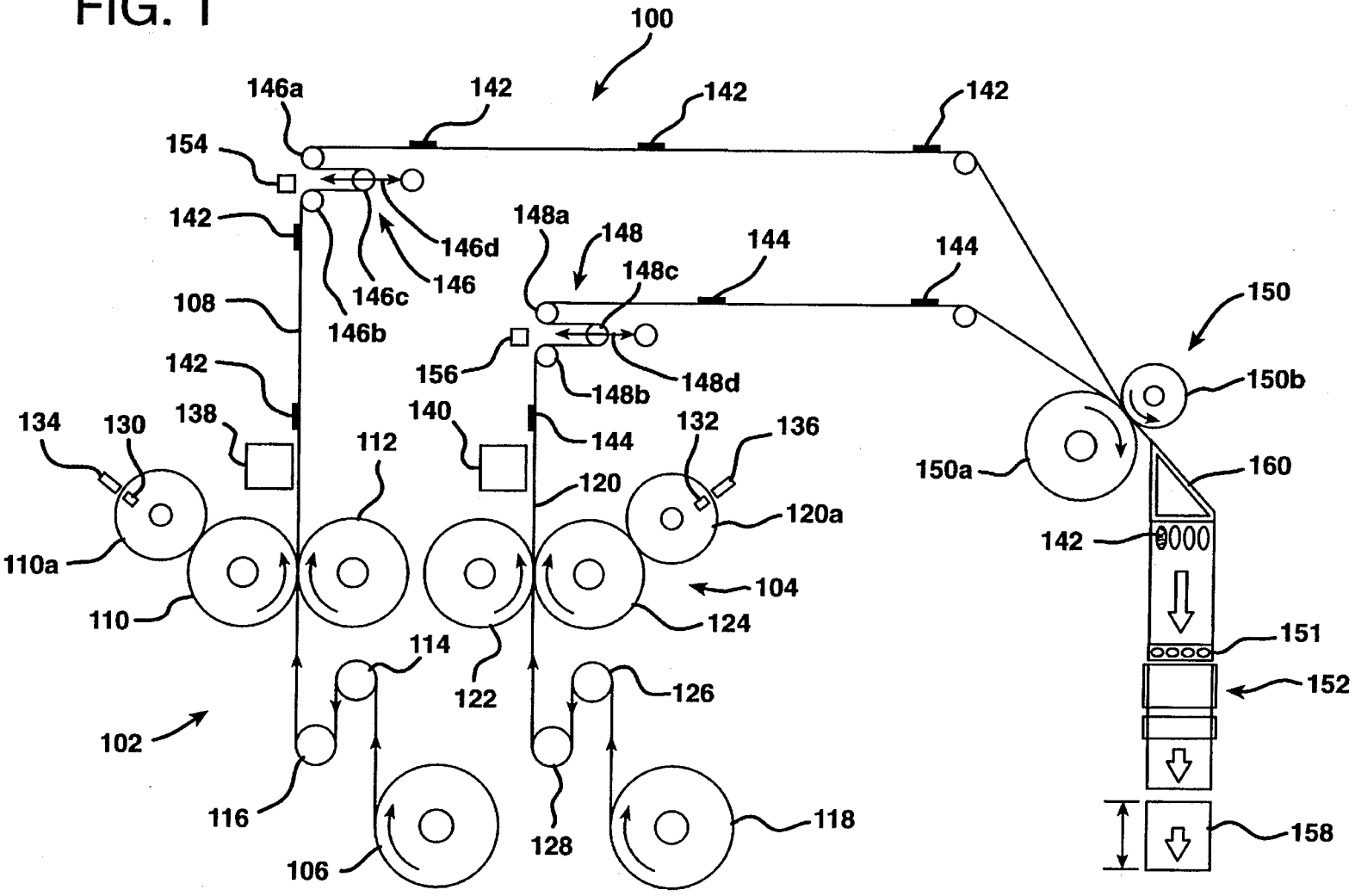
FIG. 1 is a simplified diagrammatic representation of a printing press with two printing units in accordance with the present invention.

A continuous web printing press 100 including first and second printing units 102, 104 for printing images on paper webs in accordance with the present invention is shown in FIG. 1. The first printing unit 102 has a paper roll 106 for supplying a paper web 108 to blanket cylinders 110, 112 via a pair of rollers 114, 116. Similarly, the second printing unit 104 includes a paper roll 118 for supplying a paper web 120 to blanket cylinders 122, 124 via a pair of rollers 126, 128. Plate cylinders 110*a*, 120*a* supply ink to the surfaces of the blanket cylinders 110, 124 respectively. Although not shown, similar plate cylinders provide ink to blanket cylinders 112, 122 in a well known manner.

The blanket cylinders 110, 112, 122, 124 transfer ink onto both sides of the respective webs 108, 120. Although each printing unit 102, 104 is shown having only two blanket cylinders 110, 112 and 122, 124, it should be understood that the present invention may be advantageously implemented on printing units having more than two blanket cylinders for each web, such as for applying different color inks to the webs. Since the structure and philosophy of color printing systems are well known in the art and are not important to the present invention, they will not be further discussed.

Figure 2:
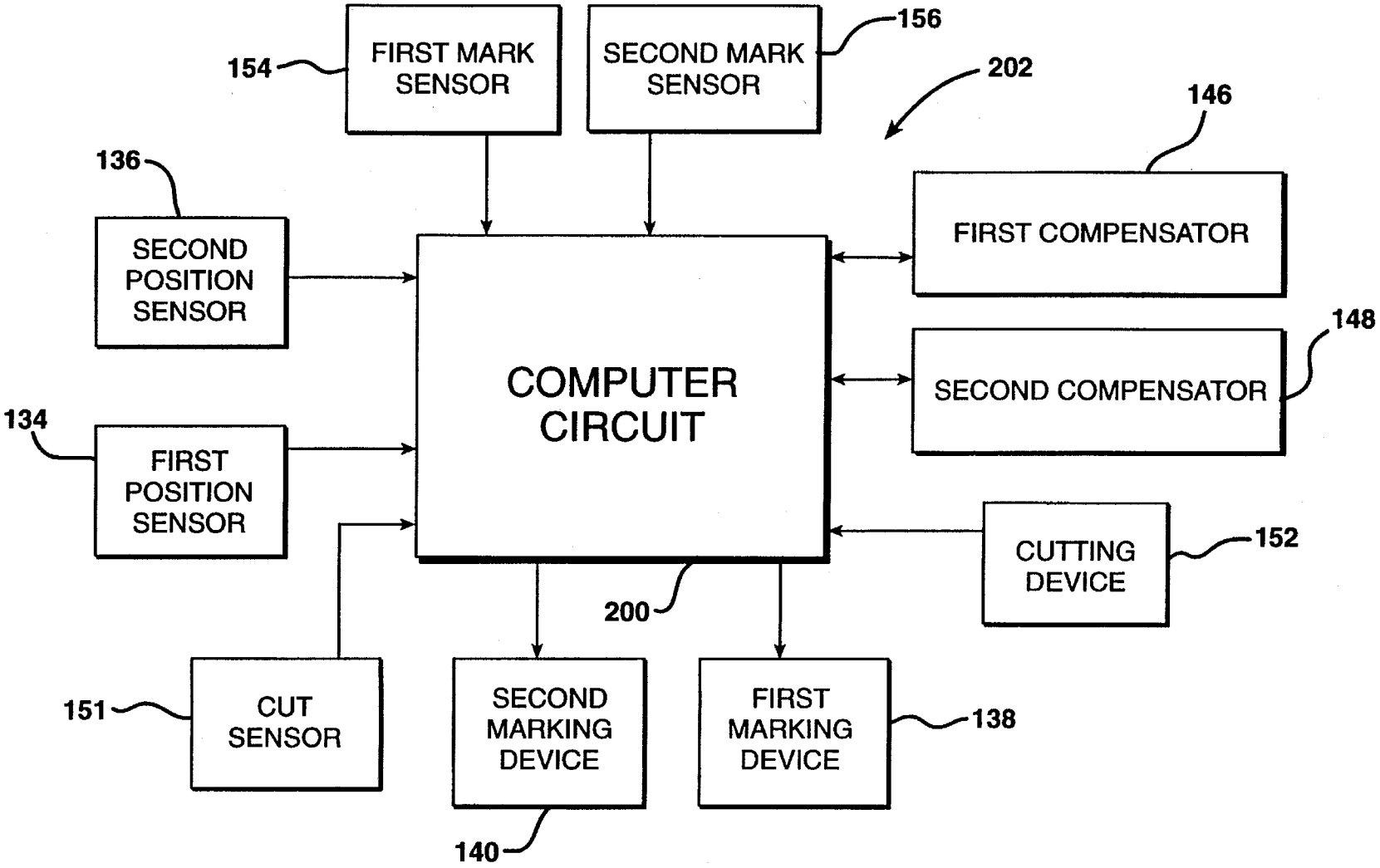
FIG. 2 is a simplified block diagram of a control system for the printing press shown in FIG. 1 for automatically identifying which paper web is running through which compensator.

The plate cylinders 110*a*, 120*a*, or any other cylinders in the printing unit, may have first and second permanent magnets 130, 132 embedded at known locations adjacent the outer surfaces of the cylinders 110*a*, 120*a* and associated first and second position sensors 134, 136 for determining when the magnets 130, 132 are located adjacent the respective position sensors 134, 136. Each sensor 134 or 136 supplies a signal to a computer circuit 200, shown in FIG. 2, when the sensor 134, 136 is adjacent its respective magnet 130, 132. The computer circuit 200, which may consist of microprocessors, memory devices and the like, is a part of a press control system, generally designated by reference numeral 202 in FIG. 2, which uses the signals from the sensors 134, 136 to control the operation of the press, such as web path lengths and the like.

Downstream from the printing units 102, 104, first and second marking devices 138, 140 apply detectable reference marks 142, 144, respectively, on the first and second webs 108, 120 to uniquely identify each web 108, 120. Preferably, the reference marks 142, 144 are comprised of magnetized materials, such as magnetized labels, which can be sensed by non-contact sensors, such as convention Hall Effect sensors. Alternatively, a magnetizable ink, such as ink containing ferrite particles, may be applied to the webs 108, 120 and thereafter magnetized. Any number of available techniques may be advantageously employed in the present invention for applying reference marks 142, 144 to the webs 108, 120. Since the structure and philosophy of the marking devices 138, 140 are not important to the present invention beyond applying a detectable reference mark to a paper web, they will not be further discussed.

A conventional first compensator 146 regulates the path length of the first web 108 in response to the computer circuit 200. Similarly, a second compensator 148 is provided to regulate the path length of the second web 120 in response to the computer circuit 200. Each compensator 146, 148 has a pair of idler rollers 146*a*, 146*b* and 148*a*, 148*b* and a compensator roller 146*c*, 148*c*. The compensator rollers 146*c*, 148*c* are movable as indicated by respective arrows 146*d*, 148*d* towards and away from the idler rollers 146*a*, 146*b* and 148*a*, 148*b* in order to decrease and increase, respectively, the path lengths of the webs 108, 120.

A conventional combining apparatus 150, which is shown for example consisting of a roller 150*a* and a trolley 150*b*, superimposes the first web 108 onto the second web 120 prior to folding by a conventional wedge-like folder board 160. The webs 108, 120 are then cut into detached pages 158 by a conventional cutting mechanism 152. A cut sensor 151 is mounted on the cutting mechanism 152 for detecting the reference marks 142, 144 and, in response, sending a signal to the computer circuit 200. The computer circuit 200 activates the appropriate compensator 142 or 148 in response to the cut sensor 151 to adjust the path lengths of the webs 142, 144 such that the cutting mechanism 152 cuts the webs 142, 144 into the detached pages 158.

The timing of the arrival of the reference marks 142, 144 at the cut sensor 151 is used to regulate the path lengths of the webs 108, 120 via the compensators 146, 148. The computer circuit 200 knows which compensator 146, 148 to activate based on the automatic identification of which web 108, 120 is running through which compensator 146, 148, as described below. Exemplary control systems for cutting webs are disclosed in commonly assigned U.S. patent application Ser. No. 08/203,261, entitled "Continuous Web Printing Press With Page Cutting Control Apparatus And Method" which was filed on Feb. 28, 1994, and in U.S. Pat. No. 5,289,770, entitled "Device For Presetting A Cut-Off Register In A Folder Of A Web-Fed Printing Press" issued to Hern on Mar. 1, 1994, the disclosures of which are hereby incorporated by reference.

Figure 3:
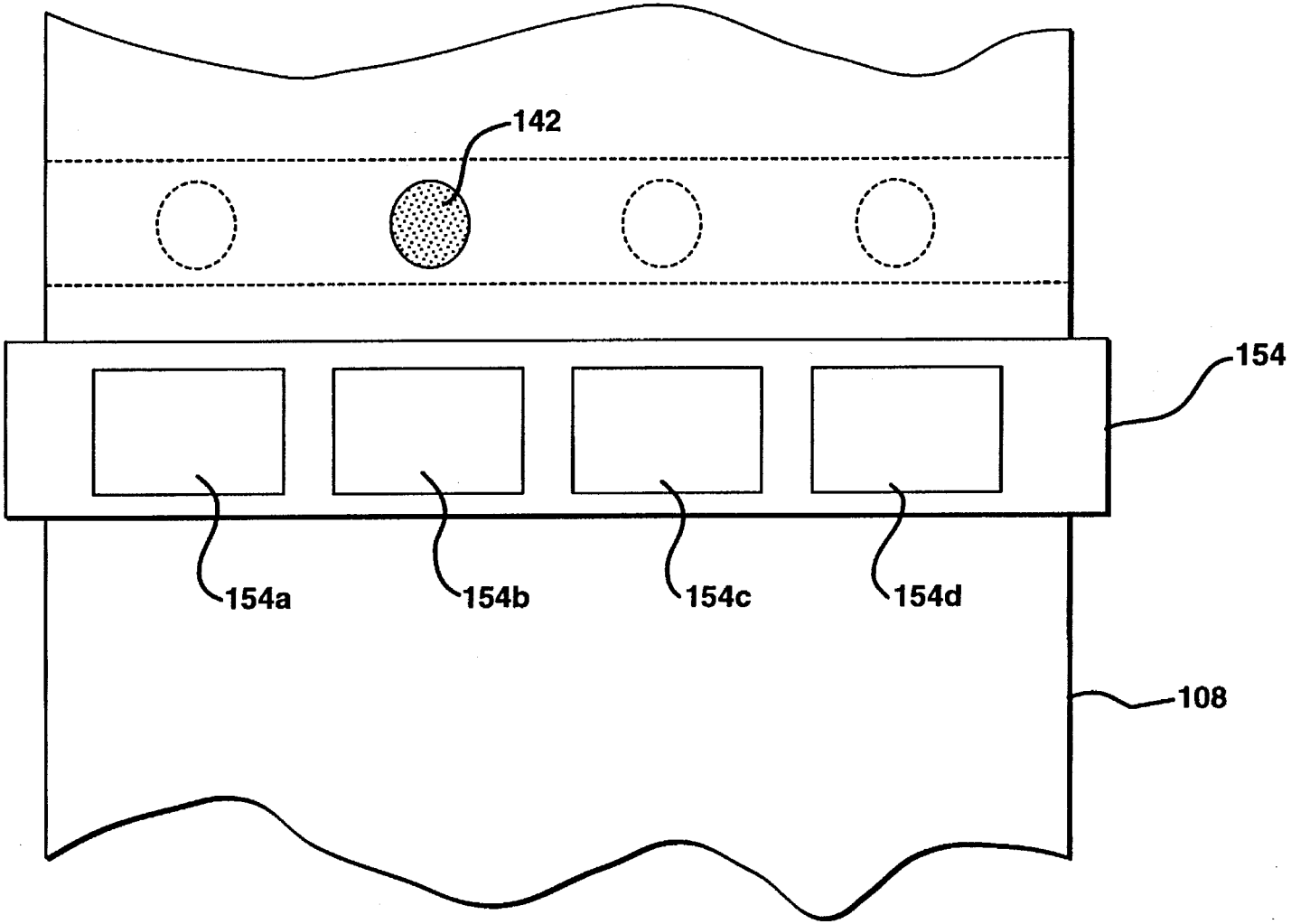
FIG. 3 is a simplified diagrammatic representation of a mark sensor mounted at a compensator for detecting reference marks applied to a web.

A first mark sensor 154 is positioned at the first compensator 146 to sense the location of the reference marks 142 on the first web 108. Any of a number of available sensors, such as Hall Effect sensors, may be used. As shown in FIG. 3, the first mark sensor 154 consists of, for example, four individual sensors 154*a*, 154*b*, 154*c*, 154*d* spaced substantially evenly across the width of the web 108. The sensors 154*a*, 154*b*, 154*c*, 154*d* are spaced so that only reference marks at one predetermined location on the web 108 will pass through the field of detection of each sensor. In the example shown, the sensor 154*b* will only detect the reference mark 142. The first mark sensor 154 then sends a signal to the computer circuit 200 indicating that the sensor 154*b* detected the reference mark 142 and, consequently, uniquely identifying the web 108 running through the first compensator 146. The computer circuit 200 is thus able to automatically identify which web 108, 120 is running through which compensator 146, 148.

A second mark sensor 156, which is preferably substantially identical to the first mark sensor 154, detects the location of the reference marks 144 on the second web 120 in a similar manner. The computer circuit 200 then uniquely identifies which web 108, 120 is running through which compensator 146, 148 based on the location of the respective reference marks 142, 144. Based on the identification of the webs 108, 120 and other operating characteristics of the press 100, such as web position determined via the position sensors 134, 136, the computer circuit 200 controls the lengths of the paths of the webs 108, 120 by activating the appropriate compensator 146, 148 in a conventional manner.

The preferred method for uniquely identifying one of a plurality of webs 108, 120 in a printing press 100 includes the steps of applying unique reference marks 142, 144 to each web 108, 120 and running each web 108, 120 through a corresponding one of a plurality of compensators 146, 148 for regulating the length of the paths of the web 108, 120 running therethrough. The reference marks 142, 144 applied to each web 108, 120 are sensed by means of sensors 154, 156 positioned at each compensator 146, 148. The method further includes the step of uniquely identifying which web 108, 120 is running through which compensator 146, 148 based on the sensed reference marks 142, 144.

The step of applying unique reference marks 142, 144 preferably comprises the step of applying a magnetized material to each web 108, 120. The step of applying unique reference marks 142, 144 may further comprise the step of applying reference marks 142, 144 at predetermined locations on each web 108, 120 to uniquely identify each web 108, 120. The step of uniquely identifying which web 108, 120 may further comprise the step of detecting the locations of the reference marks 142, 144 on each web 108, 120.

Advantageously, the present invention provides for automatically uniquely identifying which web is running through which compensator, thus eliminating the manual identification otherwise required by the operator of the press.

Having thus described the invention in detail by way of reference to preferred embodiments thereof, it will be apparent that other modifications and variations are possible without departing from the scope of the invention defined in the appended claims. For example, the first and second mark sensors 154, 156 may further be used to detect the speed of the webs by comparing the times which reference marks traverse the sensors 154, 156 to the times the reference marks 142, 144 traverse another point in the press, such as the cut sensors.

What is claimed is:

1. A control system for a printing press which prints an image on a web and includes a compensator for regulating the length of the web, the control system comprising:

a marking device for applying detectable reference marks on the web to uniquely identify the web;

a mark sensor located at the compensator for detecting reference marks on the web running through the compensator; and a computer circuit responsive to the mark sensor for uniquely identifying the web running through the compensator based on the detected reference marks and for controlling printing press operation based on the identification of the web.

2. The control system as recited in claim 1 wherein the computer circuit controls the compensator to regulate a path length of the web based on the identification of the web.

3. The control system as recited in claim 2 wherein the reference marks applied by the marking device are magnetized.

4. The control system as recited in claim 2 wherein the marking device applies the detectable reference marks at predetermined locations on the web such that the location of the reference marks uniquely identifies the web.

5. A printing press comprising:

a first printing unit adapted to print on a first web running therethrough;

a first marking device for applying first reference marks to the first web to uniquely identify the first web;

a first compensator for controlling a path length of the first web;

a first mark sensor positioned at the first compensator for detecting the first reference marks on the first web; and a computer circuit responsive to the first mark sensor for uniquely identifying the first web based on the detected first reference marks and for regulating the first compensator based on the identification of the first web.

6. The printing press as recited in claim 5 wherein, the first mark sensor detects the location of the first reference marks on the first web and wherein, the computer circuit uniquely identifies the first web based on the location of the first reference marks.

7. The printing press as recited in claim 5 comprising a second printing unit adapted to print on a second web running therethrough;

a second marking device for applying second reference marks to the second web to uniquely identify the second web;

a second compensator for controlling a path length of the second web; and a second mark sensor positioned at the second compensator for detecting the second reference marks on the second web and wherein, the computer circuit responsive to the second mark sensor uniquely identifies the second web based on the detected second reference marks and regulates the first and second compensators based on the identification of the first and second webs.

8. The printing press as recited in claim 7 wherein the second mark sensor detects the location of the second reference marks on the second web and wherein, the computer circuit uniquely identifies the second web based on the location of the second reference marks.

9. The printing press as recited in claim 7 wherein the first printing unit comprises a first web position sensor for detecting the position of the first web and wherein, the computer circuit activates the first marking device to control the application of the first reference marks based on the sensed position of the first web.

10. The printing press as recited in claim 9 wherein the second printing unit comprises a second web position sensor for detecting the position of the second web and wherein, the computer circuit activates the second marking device to control the application of the second reference marks based on the sensed position of the second web.

11. The printing press as recited in claim 10 comprising a cutting mechanism for cutting the first web and the second web in response to the position of the first cylinder.

12. The printing press as recited in claim 11 comprising a combining apparatus for superimposing the first web and the second web prior to cutting the first and second webs by the cutting mechanism.

13. A method for uniquely identifying one of a plurality of webs in a printing press comprising the steps of:

applying unique reference marks to each web;

running each web through a corresponding one of a plurality of compensators for regulating path length of the web running therethrough;

sensing the reference marks applied to each web by means of sensors positioned at each compensator; and uniquely identifying which web is running through which compensator based on the sensed reference marks.

14. The method as recited in claim 13 wherein the step of applying unique reference marks comprises the step of applying a magnetized material to each web.

15. The method as recited in claim 14 wherein the step of applying unique reference marks comprises the step of applying reference marks at predetermined locations on each web to uniquely identify each web.

16. The method as recited in claim 15 wherein the step of uniquely identifying which web comprises the step of detecting the locations of the reference marks on each web.

* * * * *